US006273415B1

(12) United States Patent
Tengo et al.

(10) Patent No.: US 6,273,415 B1
(45) Date of Patent: Aug. 14, 2001

(54) MEMBER FOR OFFICE MACHINES

(75) Inventors: Yuichiro Tengo; Yukio Ando, both of Kanagawa-ken (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/473,945

(22) Filed: Dec. 29, 1999

(30) Foreign Application Priority Data

Jan. 7, 1999 (JP) ..... 11-002301

(51) Int. Cl.[7] ..... B65H 3/06
(52) U.S. Cl. ..... 271/109; 271/119
(58) Field of Search ..... 271/109, 119; 492/53, 56, 59

(56) References Cited

U.S. PATENT DOCUMENTS 4,664,252 * 5/1987 Galbraith ..... 271/109 X
6,032,943 * 3/2000 Yabushita et al. ..... 271/109
6,139,006 * 10/2000 Asada ..... 271/109 X

* cited by examiner

*Primary Examiner*—David H. Bollinger
(74) *Attorney, Agent, or Firm*—Oblon, Spivak, McClelland, Maier & Neustadt, P.C.

(57) ABSTRACT

There is disclosed a member for office machines which comprises a core body and an annular elastic body installed on the peripheral surface thereof, wherein the expansion rate of the annular elastic body E(%) falls within the range of 5 to 30%, when expressed by the formula $$E(\%)=\{(d_1-d_2)/d_2\}\times 100$$

wherein $d_1$ in mm is the diameter of the core body, or a longest value in the cross-section of the core body in the shape of a roller or odd-shape; and $d_2$ in mm is the inside diameter in mm of the annular elastic body before being installed on the peripheral surface of the core body. The member for office machines enables stable and steady paper sheet feeding, when used as a paper feeding member in electrophotographic equipment and electrostatic recording equipment, and equipment having a variety of paper feeding mechanisms such as ink-jet printers, automatic teller machines (ATM), money exchange machines, counting machines, automatic vending machines and cash dispensers (CD).

12 Claims, 2 Drawing Sheets

MEMBER FOR OFFICE MACHINES

BACKGROUND OF THE INVENTION

1. Field of the Invention

The present invention relates to a member for office machines. More particularly, the present invention pertains to a member for office machines which has a high friction coefficient, and is well suited for use in electrophotographic equipment and electrostatic recording equipment such as copying machines, laser printers and facsimile equipment, and further for use, as a paper feeding member, in machinery and equipment having a variety of paper feeding mechanisms such as ink-jet printers, automatic teller machines (ATM) money exchange machines, counting machines, automatic vending machines and cash dispensers (CD).

2. Description of the Related Arts

There is employed a member for office machines such as a roller and a belt in electrophotographic equipment and electrostatic recording equipment such as copying machines, laser printers and facsimile equipment, and further in such equipment as electrifying equipment, transfer equipment, developing equipment, deelectrifying equipment, paper feeding equipment and cleaning equipment.

Of these members, the paper feeding member which feeds sheets of paper by taking advantage of friction of a rubber roller or the like, is required to have excellent paper feeding characteristics, antifouling properties against paper, films and photographic printing paper, favorable durability and the like properties. Thus there have been proposed paper feeding members with various shapes and/or constructional materials.

There have heretofore been employed, for the aforesaid paper feeding members, vulcanized rubber such as silicone rubber, polyurethane rubber, styrene/butadiene rubber, butadiene rubber and ethylene/propylene rubber. In addition, attention has been paid in recent years to thermoplastic elastomers, which have come into use in combination with a softening agent.

Moreover, there has recently been brought into use, a paper feeding member in which a rubbery elastic body layer is installed on the peripheral surface of a core body having a cross-section in the form of a segment (including the form of spherical roller) or an eccentric core body.

In the case where the aforesaid paper feeding member is rotated, there are formed both a portion out of contact with paper sheets and a portion in contact with paper sheets. The paper feeding is carried out by the friction between the rubbery elastic body layer and the paper sheets when the peripheral surface of the layer comes in contact with the paper sheets. On the other hand, when the peripheral surface of the layer is out of contact with the paper sheets, the paper feeding member runs idle, thereby failing to feed paper sheets. The above-mentioned paper feeding member having such a feeding mechanism is imparted with excellent paper feeding characteristics including the capability of preventing double feeding and steadily feeding paper sheets.

In order that the above-mentioned paper feeding member may maintain stable paper feeding characteristics by taking advantage of friction of a rubbery elastic body layer, it is required to minimize variation in the friction coefficient thereof with the lapse of time (that is, an increase in the number of paper feeding times).

In general, however, the paper feeding member composed of the foregoing materials frequently brings about such an unfavorable circumstance that powders of silica, calcium carbonate, etc. and/or fibrous paper powders adhere to the surfaces of the paper feeding member during use, whereby the friction coefficient is lowered, thus making it impossible to steadily feed paper sheets. The aforesaid disadvantage tends to frequently occur particularly at the time of using reclaimed paper or art paper to be used for carrying out high quality printing.

For the purpose of preventing such disadvantage and inconvenience, there have heretofore been adopted several methods in which (1) the surface layer of the paper feeding member is abraded at every time of paper feeding so that the friction coefficient of the surface approaches the initial value; (2) a convex portion is provided on the surface of the member so as to impart a driving force to paper sheets; (3) a material having a high friction coefficient is used as the material for the member so that a moderate friction coefficient and paper sheet transport capacity are preserved even after the lowering of the friction coefficient due to the adhesion of paper powders and the like; (4) the tacky adhesion of the member surface is suppressed so as to alleviate the adhesion of paper powders.

Nevertheless at the present time, the method (1) brings about the problem that the capacities of paper feeding and transport are lowered and further, the service life of the member itself is inevitably shortened; and the foregoing methods (2) to (4) fails to exert sufficiently satisfactory working effect.

SUMMARY OF THE INVENTION

Under such circumstances, a general object of the present invention is to provide a member for office machines which is used as a paper feeding member capable of stable paper feeding in various equipment having a variety of paper feeding mechanisms. Other objects of the present invention will be obvious from the text of this specification hereinafter disclosed.

In such circumstance, intensive research and investigation were accumulated by the present inventors in order to achieve the above-mentioned objects, that is, to develop a paper feeding member capable of stable paper feeding. As a result, it has been found that by equipping the member with an annular elastic body on the peripheral surface of a core body so that the expansion rate of said annular elastic body falls within a specific range, it is made possible to enhance the friction coefficient of the body portion in contact with paper sheets without appreciably lowering the abrasion resistance thereof, maintain a moderate friction coefficient even after the lowering thereof due to the adhesion of paper powders with the lapse of time, and thus preserve paper sheets transport capacity. It has also been found that by providing the annular elastic body having different thickness in part so that the friction coefficient of the portion thereof in contact with the paper sheets differs in part, it is made possible to enhance the paper sheets transport capacity at the portion having a higher friction coefficient, and further to enhance paper sheets releasability at the portion having a lower friction coefficient, whereby a paper feeding member having excellent functions is obtained. The present invention has been accomplished by the foregoing findings and information.

That is to say, the present invention provides a member for office machines which comprises a core body and an annular elastic body installed on the peripheral surface thereof, characterized in that the expansion rate of said annular elastic body E(%) falls within the range of 5 to 30%, when expressed by the formula $$E(\%)=\{(d_1-d_2)/d_2\}\times 100$$

wherein $d_1$ in mm is the diameter of the core body with the proviso that in the case where the core body is in the form of a roller or odd-shaped, a longest portion in its cross-section is regarded as the diameter; and $d_2$ in mm is the inside diameter in mm of the annular elastic body before being installed on the peripheral surface of said core body.

The term "a member for office machines" as used herein is the general concept including any member for electrophotographic equipment and electrostatic recording equipment, and any member for equipment having a variety of paper feeding mechanisms such as ink-jet printers, automatic teller machines (ATM), money exchange machines, counting machines, automatic vending machines and cash dispensers (CD).

Figure 1:
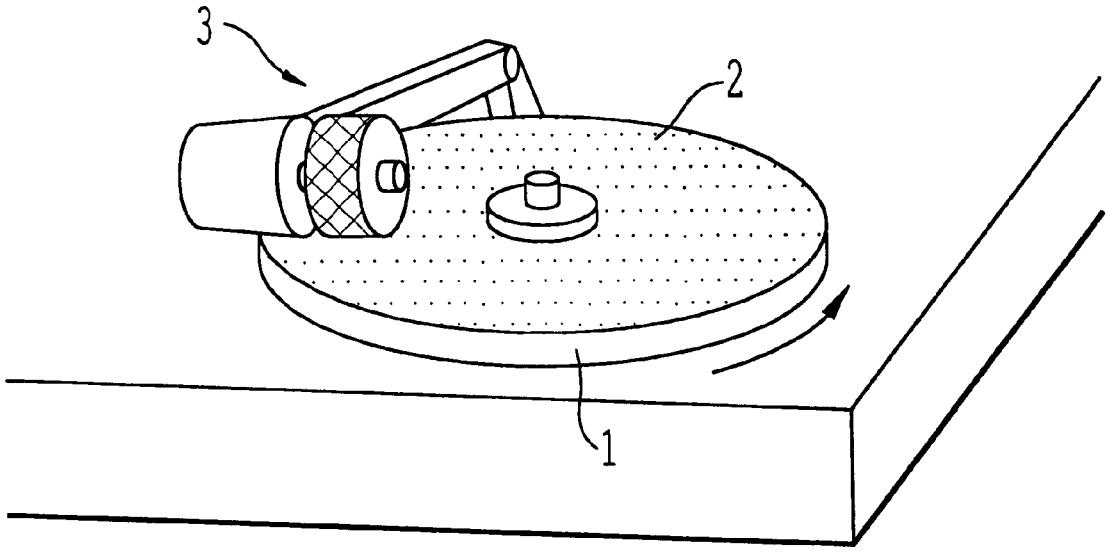
FIG. 1 is a schematic illustration of a Taber abrasion testing machine which was used for evaluating the abrasion resistance of a member for office machines according to the present invention.

1: turntable, 2: emery paper, 3: member for office machines, 4: core body, 5: annular elastic body, 6: shaft insertion hole, 7: shaft, 8: paper feeding member, 9: paper feeding roller

DESCRIPTION OF PREFERRED EMBODIMENT

The member for office machines according to the present invention (hereinafter sometimes abbreviated to "member of the present invention") is used mainly as a paper feeding member in apparatuses having a variety of paper feeding mechanisms, and comprises a core body and an annular elastic body installed on the peripheral surface thereof. The shape of the core body is not specifically limited, but may be properly selected according to the purpose of use from a variety of shapes which have heretofore been used for a member for office machines such as, for instance, segmental cross-section (part of a circle cut off by a line or roller shape), eccentric cross-section and circular cross-section (cylindrical core body). Preferable core bodies among them are cylindrical core body and a core body having a segmental cross-section.

The material for the core body is not specifically limited, but may be selected according to the situation from the materials which have heretofore been customarily used as a core material for office machines. Said materials are exemplified by plastics such as ABS, POM, polycarbonate and nylon, and metals such as aluminum, SUS and magnesium alloys, and may be selected for use according to the situations. The core body may have a shaft at the rotational center thereof, and also a hole for fitting the shaft.

In the case where the core body has a segmental cross-section (roller), the peripheral surface is constituted of curved surface coming in contact with paper sheets and plane surface connected thereto. When the core body has a circular cross-section (cylindrical core body), the peripheral surface comes in contact with paper sheets at any place.

In the case where the core body has a segmental cross-section, there are no specific limitations on the length of the plane surface in the direction of the rotational axis, the maximum diameter of the curved surface, and the length and diameter of the cylindrical portion. These factors can be properly selected for use according to the situations such as the purpose of use.

With regard to the member of the present invention, the annular elastic body is installed on the peripheral surface of the core body so that the expansion rate of said annular elastic body E(%) falls within the range of 5 to 30% when expressed by the formula $$E(\%)=\{(d_1-d_2)/d_2\}\times 100$$

wherein $d_1$ in mm is the diameter of the core body with the proviso that in the case where the core body is in the form of a roller or odd-shaped, a longest portion in its cross-section is regarded as the diameter; and $d_2$ in mm is the inside diameter in mm of the annular elastic body before being installed on the peripheral surface of said core body.

The expansion rate E(%), when being less than 5% leads to the fear of causing slip between the annular elastic body and the core body, whereas the E(%), when being more than 30%, results in steep decrease in abrasion resistance without significantly increasing the static and dynamic friction coefficients in proportion to the increased E(%). Taking into consideration the possible slip between the annular elastic body and the core body as well as static and dynamic friction coefficients, the expansion rate E(%) is preferably in the range of 10 to 25%.

In the case where the member of the present invention is used as a paper feeding member, and also when the expansion rate falls within the above-mentioned range, the static friction coefficient, the dynamic friction coefficient and abrasion resistance (expressed in terms of weight variation rate) at the place in contact with paper sheets, although depend upon the thickness of the annular elastic body, are generally at least 1.5, at least 2.0 and at most 0.05%, respectively. The portion of the member in contact with paper sheets varies depending upon the shape of the core body. A cylindrical core body causes any peripheral surface to come into contact with paper sheets, whereas a core body having a segmental cross section (roller type) causes curved peripheral surface to come into contact therewith without causing plane peripheral surface to come into contact therewith.

The aforesaid static and dynamic friction coefficients are measured in accordance with JIS K7125. The abrasion resistance is measured in accordance with the following procedure. FIG. 1 is a schematic illustration of a Taber abrasion testing machine used for evaluating the abrasion resistance. On the surface of the turntable 1 of the machine was placed #1000 emery paper 2, with which a member 3 for office machines according to the present invention is brought into contact. A load of 250 gf is applied to said member 3, and a measurement is made of the abrasion loss of the rubber in accordance with JIS K7125, when the table is rotated 1000 times. Thus the weight variation rate is represented by the formula $$\text{Weight variation rate } (\%)=\{(W_0-W_1)/W_0\}\times 100$$

wherein $W_1$ is the weight of the member after the abrasion test, and $W_0$ is the weight of the member before said test. The abrasion resistance of the member is evaluated from the weight variation rate thus calculated, and is worsened with an increase in the weight variation rate.

In general, the upper limits of the static and dynamic friction coefficients are each approximately 4.0, and the lower limit of the abrasion resistance (weight variation rate) is approximately 0.01%.

Since the static and dynamic friction coefficients inevitably depend upon the thickness of the annular elastic body, by increasing the thickness of part of the annular elastic body, the friction coefficients at the part are lowered. Consequently, it is made possible to improve the transport capacity of paper sheets by taking advantage of the portion having relatively high friction coefficients, and also to impart the member with the function of enhancing the releasability of paper sheets at the portion having relatively low friction coefficients.

In the present invention, the thickness of the annular elastic body is not specifically limited, but is generally selected in the range of 1 to 10 mm.

The annular elastic body to be used in the member of the present invention is usually composed of a high molecular material containing a thermoplastic high molecular compound. Examples of said compound used in said material include (1) thermoplastic elastomers (including hydrogenated and modified products), (2) thermoplastic resins and rubber-modified products, and (3) rubbery elastic bodies.

In the following, some description will be given of the thermoplastic elastomers and rubbery elastic bodies.

The thermoplastic elastomers may be optionally selected for use from those which have heretofore been customarily used as the material for paper sheet feeding, for instance, from polyolefin base, polyurethane base, polyester base, polyamide base and polystyrene base. Particularly preferable thermoplastic elastomers are those having both the moiety more apt to form hard blocks such as crystalline structure or agglomerate structure, and soft blocks such as amorphous structure. These are specifically exemplified by the following $\hat{1}$ to $\hat{3}$.

$\hat{1}$ a block copolymer of crystalline polyethylene and ethylene/butylene-styrene random copolymer, said block copolymer being produced by hydrogenating a block copolymer of polybutadiene and butadiene-styrene random copolymer.

$\hat{2}$ a diblock copolymer of crystalline polyethylene and poly-styrene; a triblock copolymer of styrene-ethylene/butylene-styrene; a triblock copolymer of styrene-ethylene/propylene-styrene; especially block copolymer of styrene-ethylene/butylene-styrene; block copolymer of styrene-ethylene/propylene-styrene, each being produced by hydrogenating a block copolymer of polybutadiene and polystyrene or a block copolymer of polybutadiene or ethylene-butadiene random copolymer and polystyrene.

$\hat{3}$ a a block copolymer in which crystalline polyethylene is connected to either or both ends of ethylene/butylene copolymer.

Of these, is particularly preferable a hydrogenated block copolymer which is obtained by hydrogenating the block copolymer constituted of at least one polymer block containing a vinyl aromatic compound as a principal component and at least one polymer block containing a conjugated diene compound as a principal component, as is exemplified in the preceding item $\hat{2}$, and which has a number-average molecular weight in the range of 150,000 to 400,000.

Any of these thermoplastic elastomers may be used alone or in combination with at least one other component.

On the one hand, the rubbery elastic body is exemplified by general rubber such as ethylene/propylene rubber (EPR), ethylene/propylene/diene tercopolymer rubber (EPDM), natural rubber, isoprene rubber, styrene/butadiene rubber, polynorbornene rubber, butadiene rubber, nitrile rubber, chloroprene rubber, butyl rubber, halogenated butyl rubber, acrylic rubber, ethylene/vinyl acetate rubber (EVA) and urethane rubber, and special rubber such as silicone rubber, fluoro-rubber, ethylene/acrylate rubber, polyester elastomer, epichlorohydrin rubber, polysulfide rubber, hypalon and chlorinated polyethylene. Of these are preferable ethylene/propylene rubber, ethylene/propylene/diene tercopolymer rubber, natural rubber, isoprene rubber, styrene/butadiene rubber, polynorbornene rubber, butadiene rubber, chloroprene rubber, nitrile rubber, butyl rubber, halogenated butyl rubber, acrylic rubber, epichlorohydrin rubber and chlorinated polyethylene. Any of these rubbery elastic bodies may be used alone or as a blend of at least two components.

Preferable rubbery elastic bodies among them are ethylene/propylene base rubber (EP base rubber), that is, ethylene/propylene rubber(EPR), ethylene/propylene/diene tercopolymer rubber and the like, when selected from the aspect of weatherability of the member for office machines. When abrasion resistance is taken into consideration, preferable rubbery elastic body is ethylene/propylene copolymer rubber (EPDM, EPR) which has such a high molecular weight that the Mooney viscosity $ML_{1+4}$ at 100° C. comes to be at least 70, and which has an ethylene segment content in the range of 50 to 75%. Any of the above-exemplified rubbery elastic bodies may be used in combination with any of the foregoing thermoplastic elastomers.

In the above-mentioned high molecular material, a softening agent may be blended as desired for the purpose of regulating the hardness of the member to be produced.

Said softening agent is not specifically limited, but may be arbitrarily selected for use from the softening agents which have heretofore been customarily employed for plastics and rubber. Preferably, the softening agent is a low molecular substance which has a number-average molecular weight of less than 20,000 and physical properties such as a viscosity at 100° C. of $5\times10^5$ centipoise or lower, especially $1\times10^5$ centipoise or lower. From the viewpoint of molecular weight, the softening agent has a number-average molecular weight of preferably less than 20,000, more preferably less than 10,000, particularly preferably less than 5,000. The preferably usable softening agent may be usually a liquid or in the form of liquid at room temperature, and may be hydrophilic or hydrophobic.

The softening agent having such properties can be properly selected for use, for example, from a variety of softening agents for rubber or plastics including those of mineral oil base, vegetable oil base and synthetic oil base. Examples of the mineral oil base include process oils such as naphthenic base oil and paraffinic base oil. Examples of the vegetable oil base include castor oil, cotton seed oil, linseed oil, rapeseed oil, soybean oil, palm oil, coconut oil, arachis oil, Japan wax oil, pine oil, and olive oil. Of these, are preferable an oil and at least two oils each having a number-average molecular weight in the range of 450 to 5000, and being selected from mineral oil base paraffinic oil, naphthenic oil, and synthetic base polyisobutylene base oil. Any of these softening agents may be used alone or as a component in a mixture of at least two agents, provided that a plurality of agents are well compatible with each other.

In particular, in the case where a thermoplastic elastomer is used as a thermoplastic high molecular compound, it is preferable that the high molecular material to be used in the annular elastic body in the present invention, has a three-dimensional continuous network skeleton construction. Moreover, the three-dimensional continuous network skeleton construction to be formed therein has an average diameter of the skeleton of at most 50 μm, preferably at most 30 μm, an average diameter of the cell (network) of at most 500 μm, preferably at most 300 μm, and a volumetric fraction of the high molecular organic material of at most 50%, preferably at most 33%, when the volumetric fraction of the high molecular organic material is defined as: [volume of high molecular organic material/(volume of high molecular organic material+volume of softening agent)]×100%.

In order to obtain the high molecular material containing a larger amount of the softening agent and a smaller amount of the high molecular organic material, it is preferable to select both the softening agent and the high molecular organic material so that the difference in solubility parameter $\delta=(\Delta E/V)^{1/2}$($\Delta E$=molar evaporation energy, V=molar volume) therebetween becomes at most 3.0, preferably at most 2.5. The difference exceeding 3.0 is unfavorable, since a large amount of the softening agent is difficult to preserve in view of the compatibility of both the materials and in addition, the softening agent becomes more apt to cause bleeding. In addition, by the term "high molecular organic material" is meant all the thermoplastic high molecular compounds.

The member for office machines can be improved in its tackiness on the surface thereof by blending an inorganic additive with the above-mentioned high molecular organic material to be used in the present invention, wherein said inorganic additive is exemplified by clay, diatomaceous earth, silica, talc, barium sulfate, calcium carbonate, magnesium carbonate, a metal oxide, mica, graphite and aluminum hydroxide. Of these, silica is preferable in particular from the viewpoint of lessening environmental variation of tackiness. The blending amount of the inorganic additive is usually at most 20 parts by weight, preferably in the range of 5 to 10 parts by weight based on 100 parts by weight of the high molecular material.

The foregoing high molecular material to be used in the present invention may be blended at need, with a filler such as various metal powders, wooden pieces, glass powder, ceramics powders, granular or powdery solid filler such as granular or powdery polymer, and various natural or artificial short fibers and long fibers (such as straw, glass fiber, metallic fiber and a variety of polymer fibers).

It is possible to contrive weight lightening of the high molecular material by blending therein a hollow filler such as an inorganic hollow filler exemplified by glass balloon and silica balloon, an organic hollow filler composed of polyfluorovinylidene and polyfluorovinylidene copolymer. It is also possible to blend any of various foaming agents in order to improve various properties such as weight lightening of the high molecular material, and it is further possible to mechanically mix a gas therein at the time of blending.

The high molecular material to be used in the present invention may be incorporated with an additive such as well known resin components in addition to the above-described components in order to improve miscellaneous properties.

As the resin components, polyphenylene ether resin, polyolefin resin, polystyrene resin or the like can be used in combination with the high molecular material. It is made possible to improve the compression set of the high molecular material by blending the polyphenylene ether resin, and also to contrive the enhancement of the processability and heat resistance of the high molecular material by blending the polyolefin resin and/or polystyrene resin.

It is possible at need to use simultaneously with the high molecular material, such additives as exemplified by flame retardants, antistatic agents, antimicrobial agents, hindered amine base light stabilizer, ultraviolet ray absorbers, antioxidants, colorants, silicone oils, cumarone resin, cumarone indene resin, phenol terpene resin, petroleum base hydrocarbons, various tackifiers such as rosin derivatives, various adhesive-type elastomer such as Rheostomer B (trade name, produced by Riken Vinyl Industry Co., Ltd.), a thermoplastic elastomer or a resin other than that used in the present invention such as Highbler (trade name, produced by Kuraray Co., Ltd., block copolymer in which polystyrene block is bonded to both terminals of vinyl-polyisoprene block) and Nolex (trade name, produced by Nippon Zeon Co., Ltd., polynorbornene formed by ring opening polymerization of norbornene), and other thermoplastic elastomer or resin each having high polarity such as thermoplastic polyester and thermoplastic polyurethane.

The process for producing the high molecular material to be used in the present invention is not specifically limited, but well known processes are applicable thereto. For example, said high molecular material is producible by a process which comprises the steps of melt kneading the foregoing components and the additives that are used as desired by the use of a heating kneader such as a single screw extruder, a twin screw extruder, a roll, a Banbury mixer, a prabender, a kneader and a high shear type mixer.

In the case where a rubbery elastic body is used as a thermoplastic high molecular compound, said rubbery elastic body can be vulcanized by blending general rubber-compounding agents such as a vulcanizing agent (sulfur, peroxide, etc.); vulcanization accelerator {tetramethylthiuram monosulfide (NOCCELER-TS), mercaptobenzothiazole (NOCCELER-M) N-cyclo-hexyl-2-benzothiazylsulfeneamide (NOCCELER-CZ), diphenylguanidine (NOCCELER-G), etc.}; vulcanization aid {ethylene glycol dimethacrylate (EDMA), triallylisocyanate (TAIC), N,N'-m-phenylenedimaleimide (VULNOC-PM), etc.}; various fillers (carbon black, white carbon, zinc oxide, etc.); age resister (styrenated phenol (ANTIAGE SP-P), 2,6-di-tertially-butyl-4-methylphenol (NOCRAC 200), dibutyl-hydrogenphosphite (DBP) and the like.

On the one hand, in the case where a thermoplastic elastomer is used as a thermoplastic high molecular compound, said thermoplastic elastomer can be crosslinked by adding thereto, a crosslinking agent such as an organic peroxide, a crosslinking aid and the like.

Examples of the crosslinking agent which can be added for the purpose of partial crosslinking include an organic peroxide, specifically exemplified by 2,5-dimethyl-2,5-di(t-butylperoxy)-hexane; 2,5-dimethyl-2,5-di(benzoylperoxy)-hexane; t-butylperoxybenzoate; dicumylperoxide; t-butylcumyl peroxide; diisopropylbenzohydroperoxide; 1,3-bis-(t-butylperoxyisopropyl)-benzene; benzoylperodxide; and 1,1-di(t-butylperoxy)-3,3,5-trimethylcyclohexane. Examples of useful crosslinking aid include divinylbenzene; trimetylol-propane triacrylate; ethylene dimethacrylate; diallyl phthalate; quinone dioxime; phenylenebismaleimide; polyethylene glycol dimethacrylate; and an unsaturated silane compound.

In the case where the member for office machines according to the present invention is prepared, at first by the use of the above-mentioned high molecular compound, an annulus elastic body having a desired shape is prepared by means of injection molding or extrusion molding, and subsequently the annulus elastic body thus formed is fitted to the peripheral surface of a core body so that the expansion rate becomes 5 to 30%, preferably 10 to 25%.

Figure 2A:
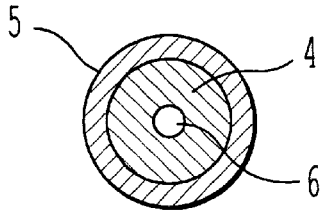
FIG. 2 includes cross-sectional views of different members for office machines according to the present invention.
Figure 2B:
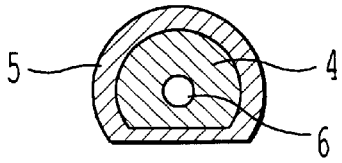
Figure 2C:
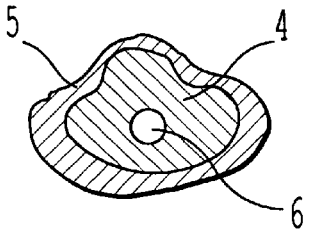

FIG. 2 illustrates different cross sections of members for office machines according to the present invention, in which (a) shows the case that an annulus elastic body is fitted to a cylindrical core body, (b) points out the case that an annulus elastic body is fitted to a core body the cross section of which is in the shape of segment (part of a circle cut off by a line or roller), and (c) indicates the case that an annulus elastic body is fitted to an odd-shaped core body. In FIG. 2, the symbols are as follows: 4; core body, 5; annulus elastic body, 6; shaft insertion hole.

Figure 3:
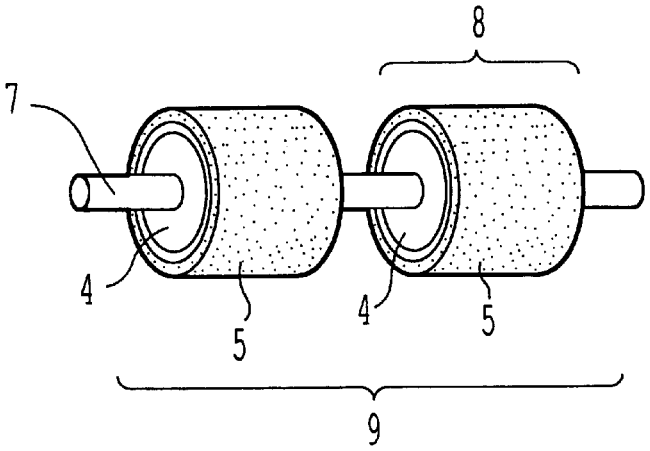
FIG. 3 is a schematic illustration of a paper feeding roller as an example of paper feeding members used as members for office machines according to the present invention, wherein the symbols 1 to 9 shall have the following designations.

FIG. 3 is a schematic illustration of a paper sheet feeding roller which is an example of a paper sheet feeding member to be used as a member for office machines according to the present invention, in which a paper sheet feeding member 8 is constituted of a core body 4 made of such a material as a resin or a metal, and an annulus elastic body 5 fitted to the peripheral surface thereof, and a shaft 7 made of a material such as a metal is inserted through a plurality of paper sheet feeding members 8 so as to constitute a paper feeding roller 9.

In summarizing the working effects and advantages of the present invention, the member for office machines according to the present invention which has a high friction coefficient and is capable of steadily feeding paper sheets, is well suited for use in electrophotographic equipment and electrostatic equipment such as copying machines, laser printers and facsimile equipment, and further for use, as a paper feeding member, in machinery and equipment having various paper feeding mechanisms such as ink-jet printers, automatic teller machines (ATM), money exchange machines, counting machines, automatic vending machines and cash dispensers (CD).

In the following, the present invention will be described in more detail with reference to working examples, which however shall not limit the present invention thereto.

EXAMPLE

An annulus elastic body in the form of cylinder having an inside diameter of 25 mm, a thickness of 2.0 mm and a length of 14 mm was prepared by injection molding a high molecular material consisting of 100 parts by weight of EPDM {manufactured by JSR Corp. under the trade name "EP33"}, 2 parts by weight of carbon black, 10 parts by weight of titanium oxide, 100 parts by weight of a process oil, 1 part by weight of sulfur and a vulcanization accelerator consisting of 1.5 part by weight of tetramethylthiuram disulfide {manufactured by Ouchi-Shinko Chemical Industrial Co., Ltd. under the trade name "NOCCELER TT"}, and 0.2 part by weight of mercaptobenzothiazole {manufactured by Ouchi-Shinko Chemical Industrial Co.,Ltd. under the trade name "NOCCELER M"}, followed by vulcanizing the injection molded product.

Subsequently, the annulus elastic body thus prepared was fitted to the peripheral surface of each of cylindrical core bodies having respective different diameters. Thus, by the use of the above-prepared annulus elastic body, measurements were made of the static friction coefficient, dynamic friction coefficient and abrasion resistance (weight variation rate) at each of expansion rates in accordance with the procedures as described in the text of the present specification. The results are given in Table 1.

TABLE 1

| | Expansion Rate (%) | | | | |
|---|---|---|---|---|---|
| | 3 | 7 | 14 | 28 | 42 |
| Static Friction Coefficient | 1.92 | 2.61 | 3.22 | 3.40 | 3.32 |
| Dynamic Friction Coefficient | 2.23 | 2.72 | 3.53 | 3.56 | 3.75 |
| Abrasion Resistance {Weight Variation Rate ($10^{-8}$%) | −7.1 | −13.5 | −24.7 | −47.1 | −69.5 |

What is claimed is:

1. A member for office machines which comprises a core body and an annular elastic body installed on the peripheral surface thereof, characterized in that the expansion rate of said annular elastic body E(%) falls within the range of 5 to 30%, when expressed by the formula $$E(\%)=\{(d_1-d_2)/d_2\}\times 100$$

wherein $d_1$ in mm is the diameter of the core body with the proviso that in the case where the core body is in the form of a roller or odd-shaped, a longest portion in its cross-section is regarded as the diameter; and $d_2$ in mm is the inside diameter in mm of the annular elastic body before being installed on the peripheral surface of said core body.

2. The member for office machines according to claim 1, wherein said member is a paper sheet feeding member.

3. The member for office machines according to claim 1, wherein said core body is in the shape of cylinder.

4. The member for office machines according to claim 1, wherein said core body has a cross-section in the shape of segment comprising a part of a circle cut off by a line.

5. The member for office machines according to claim 2, wherein the portion of the peripheral surface of said member which comes in contact with paper sheets, has a static friction coefficient of at least 1.5.

6. The member for office machines according to claim 2, wherein the portion of the peripheral surface of said member which comes in contact with paper sheets, has a dynamic friction coefficient of at least 2.0.

7. The member for office machines according to claim 5, wherein the portion of the peripheral surface of said member which comes in contact with paper sheets, has a dynamic friction coefficient of at least 2.0.

8. The member for office machines according to claim 2, wherein the portion of the peripheral surface of said member which comes in contact with paper sheets, has abrasion resistance expressed in terms of weight variation rate of at most 0.05%.

9. The member for office machines according to claim 5, wherein the portion of the peripheral surface of said member which comes in contact with paper sheets, has abrasion resistance expressed in terms of weight variation rate of at most 0.05%.

10. The member for office machines according to claim 6, wherein the portion of the peripheral surface of said member which comes in contact with paper sheets, has abrasion resistance expressed in terms of weight variation rate of at most 0.05%.

11. The member for office machines according to claim 7, wherein the portion of the peripheral surface of said member which comes in contact with paper sheets, has abrasion resistance expressed in terms of weight variation ratio of at most 0.05%.

12. The member for office machines according to claim 1, wherein the thickness of said annular elastic body is varied in part.

* * * * *